US007665317B2

(12) United States Patent
Boer et al.

(10) Patent No.: US 7,665,317 B2
(45) Date of Patent: Feb. 23, 2010

(54) METHOD FOR CONTROLLING A REFRIGERATION APPLIANCE

(75) Inventors: Alessandro Boer, Cassinetta Di Biandronno (IT); Raffaele Paganini, Varese (IT); Rocco Petrigliano, Valsinni (IT)

(73) Assignee: Whirlpool Corporation, Benton Harbor, MI (US)

( * ) Notice: Subject to any disclaimer, the term of this patent is extended or adjusted under 35 U.S.C. 154(b) by 375 days.

(21) Appl. No.: 11/572,446

(22) PCT Filed: Jul. 4, 2005

(86) PCT No.: PCT/EP2005/053163

§ 371 (c)(1),
(2), (4) Date: Jan. 22, 2007

(87) PCT Pub. No.: WO2006/008231

PCT Pub. Date: Jan. 26, 2006

(65) Prior Publication Data

US 2007/0209376 A1 Sep. 13, 2007

(30) Foreign Application Priority Data

Jul. 22, 2004 (EP) ..... 04103494

(51) Int. Cl.
*F25D 21/06* (2006.01)

(52) U.S. Cl. ..... 62/155; 62/156; 62/272

(58) Field of Classification Search ..... 62/80, 62/81, 82, 155, 156, 157, 272
See application file for complete search history.

(56) References Cited

U.S. PATENT DOCUMENTS

| | | | | |
|---|---|---|---|---|
| 4,481,785 | A * | 11/1984 | Tershak et al. | 62/153 |
| 5,666,816 | A * | 9/1997 | Jeong et al. | 62/154 |
| 5,735,134 | A * | 4/1998 | Liu et al. | 62/230 |
| 5,884,491 | A * | 3/1999 | Kim et al. | 62/89 |
| 6,550,261 | B1 | 4/2003 | Shima et al. | |
| 6,739,146 | B1 | 5/2004 | Davis et al. | |
| 2003/0101737 | A1 | 6/2003 | Bair, III et al. | |
| 2004/0130442 | A1 | 7/2004 | Breed et al. | |

FOREIGN PATENT DOCUMENTS

| | | |
|---|---|---|
| DE | 19743073 | 4/1999 |
| EP | 0686818 B1 | 12/1995 |
| EP | 0803690 B1 | 10/1997 |
| EP | 1318365 A1 | 6/2003 |
| JP | 5118732 | 5/1993 |
| RU | 2137059 | 9/1999 |
| WO | 03031891 A1 | 4/2003 |

* cited by examiner

*Primary Examiner*—Marc E Norman
(74) *Attorney, Agent, or Firm*—Kirk W. Goodwin; McGarry Bair P.C.

(57) ABSTRACT

A method for controlling the defrost of an evaporator in a refrigeration appliance provided with a compressor and in which a temperature sensor (TP) is used for detecting the temperature inside a cell of the appliance, comprises the steps of estimating the temperature of the evaporator on the basis of the cell temperature (TP) and of a mathematical model of the refrigeration appliance, and controlling the compressor on the basis of the estimated temperature of the evaporator.

17 Claims, 9 Drawing Sheets

Nomenclature for the EA algorithm

| PARAMETER | VALUE | DESCRIPTION |
|---|---|---|
| $R_{h2}$ | 0.18 [°C/W] | Refrigerator metal thermal resistance. |
| $C_1$ | 355.3 [J/°C] | Fluid thermal capacity. |
| $C_2$ | 306.394 [J(°C] | Evaporator thermal capacity. |
| $R_{h2}$ | 3.0[°C/W] | Evaporator thermal resistance. |
| $K$ | 1.7251e-4 [°C$^{-2}$] | Convective exchange coefficient. |
| $Fan$ | from 1 to 2 | Cooling Exchange coefficient depending from the FAN speed. |
| $Dt$ | 1 sec | Step time integration |
| $Q_{Sc_1}$ | 0.25 [W] | Thermal power produced by the ice formation process |
| $Q_{Sc_2}$ | -22.1368 [W] | Thermal power absorbed by the ice melting process |

Fig.9

METHOD FOR CONTROLLING A REFRIGERATION APPLIANCE

CROSS-REFERENCE TO RELATED APPLICATIONS

This application claims priority on International Application No. PCT/EP2005/053163, filed Jul. 4, 2005, which claims priority on European Application No. EP 04103494.3 filed Jul. 22, 2004.

The present invention relates to a method for controlling the defrost cycle of an evaporator in a refrigeration appliance provided with one or more actuators, in which a temperature sensor is used for detecting the temperature inside a cavity of the appliance. With the term "actuator" we mean any device which is driven by the control circuit of the appliance, for instance the compressor of the refrigeration circuit, movable dampers, fans, electrical resistance for defrosting etc.

All the static evaporators used for refrigerator cabinets are provided with a temperature sensor directly in contact with them. Said sensor is used by the temperature controller not only to control the temperature in the cavity but also to detect the end of the defrost phase. This is done by comparing its temperature with an appropriated value (in general higher than 0° C.). For this purpose, both electromechanical sensors (thermostats) and electronic sensors (i.e. NTC, PTC, thermocouples . . . ) can be used. In some cases a second temperature sensor is placed inside the refrigerator cavity to provide the control algorithm with a more precise cavity temperature.

The main object of the present invention is to remove the evaporator temperature sensor in order to save the cost related to its assembly and to solve the serviceability problems related to its inaccessible location.

Another object of the present invention is to provide a refrigerator with a single temperature sensor placed inside its cavity, which can perform a defrost cycle substantially identical to the defrost cycle performed by refrigeration appliances having a temperature sensor in contact with the evaporator.

The above objects are obtained thanks to the features listed in the appended claims.

According to the invention, the evaporator temperature sensor is replaced with an estimation algorithm able to estimate the evaporator temperature and the frost formation on the basis of a unique temperature sensor placed in a more accessible position inside the cavity. The estimation algorithm is able to estimate the evaporator temperature and its frost condition in order to manage the defrost function avoiding ice accumulation with no direct measure on the evaporator surface nor in its closeness.

The main advantages of the present invention come from the elimination of the temperature sensor traditionally present on all the static evaporators of refrigerators. These advantages can be summarized in an assembly cost saving and increased serviceability. An additional saving can be obtained if the invention is applied to a refrigerator cabinet that is traditionally provided with two temperature sensors: one on the evaporator to manage the defrost and one on the ambient to control the temperature. In this case the invention allows the elimination of the first sensor and the second one will be used for both purposes (defrost and temperature control).

The present invention will be disclosed in detail with reference to the appended drawings, in which:

FIG. 9 shows an example of parameter values used in the algorithm according to the invention.

Figure 1:
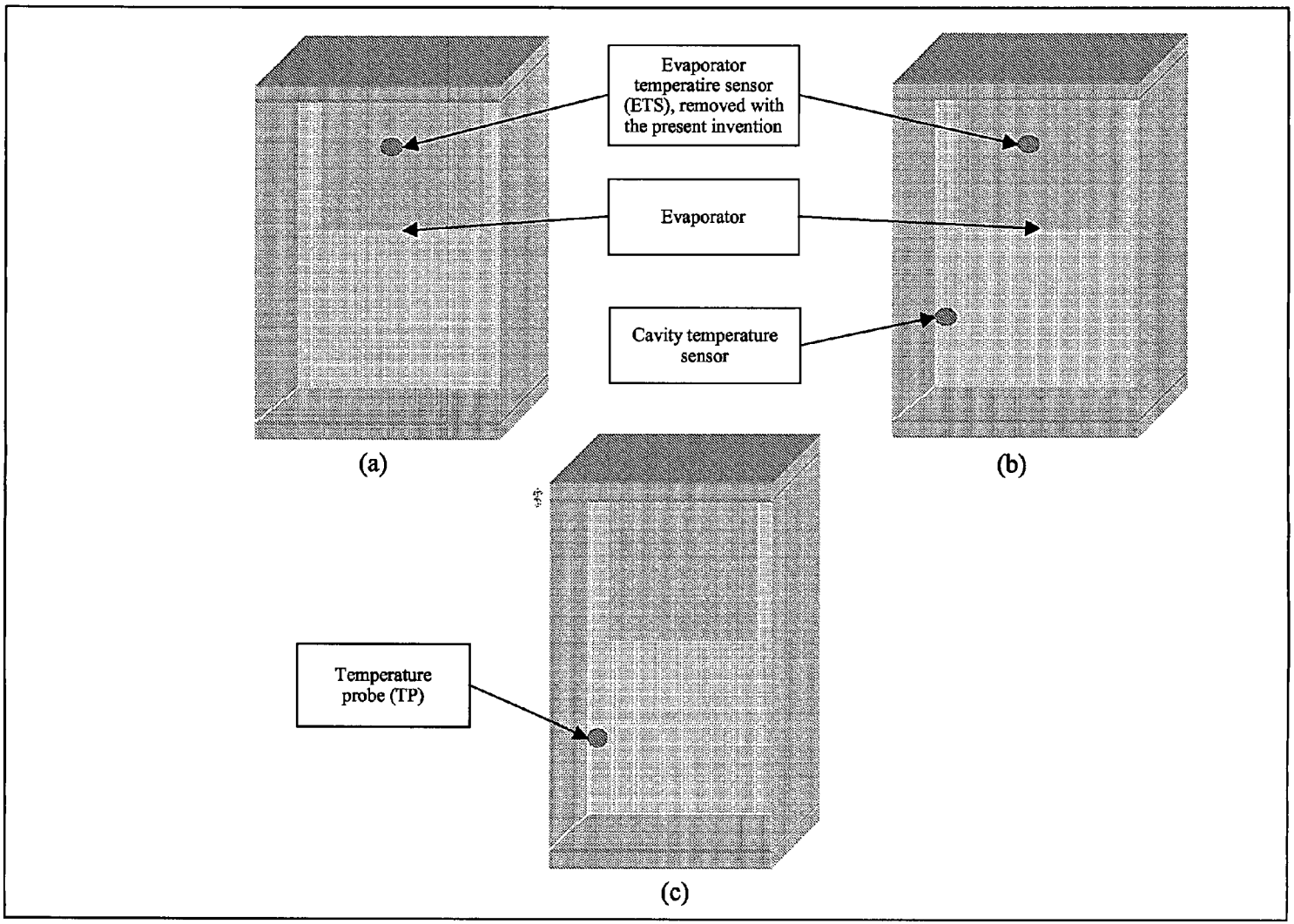
FIG. 1 is a schematic view of typical temperature sensor positions inside a static refrigerator cavity (solutions "a" and "b") and of a possible sensor position according to the present invention (solution "c")
Figure 2:
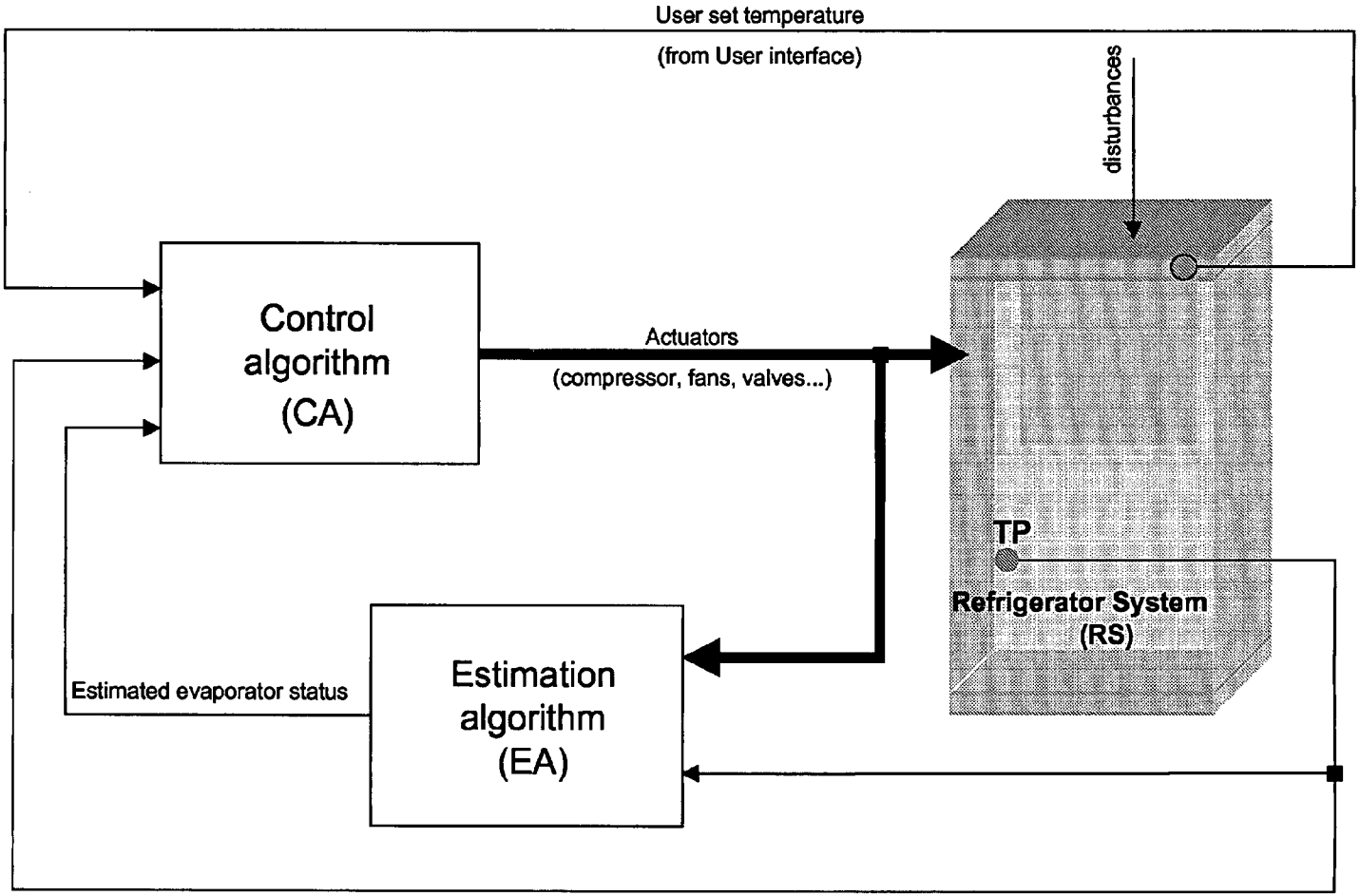
FIG. 2 is a block diagram according top the invention showing the interaction between the estimation algorithm, the control algorithm and the refrigeration system.

With reference to the drawings, in FIG. 2 it is shown a general block diagram describing the interactions between the estimation algorithm EA, the control algorithm CA and the refrigerator system RS. According to this diagram the control algorithm CA decides the status of the actuators (for instance the compressor of the refrigeration circuit) in order to guarantee an appropriated temperature control and a correct functioning of the appliance (including a good defrost management). This is done mainly on the basis of two input: the measured temperature coming from the temperature probe TP in the cavity, and the estimated evaporator conditions (for example evaporator temperature and frost amount) carried out by the estimation algorithm EA.

Figure 3:
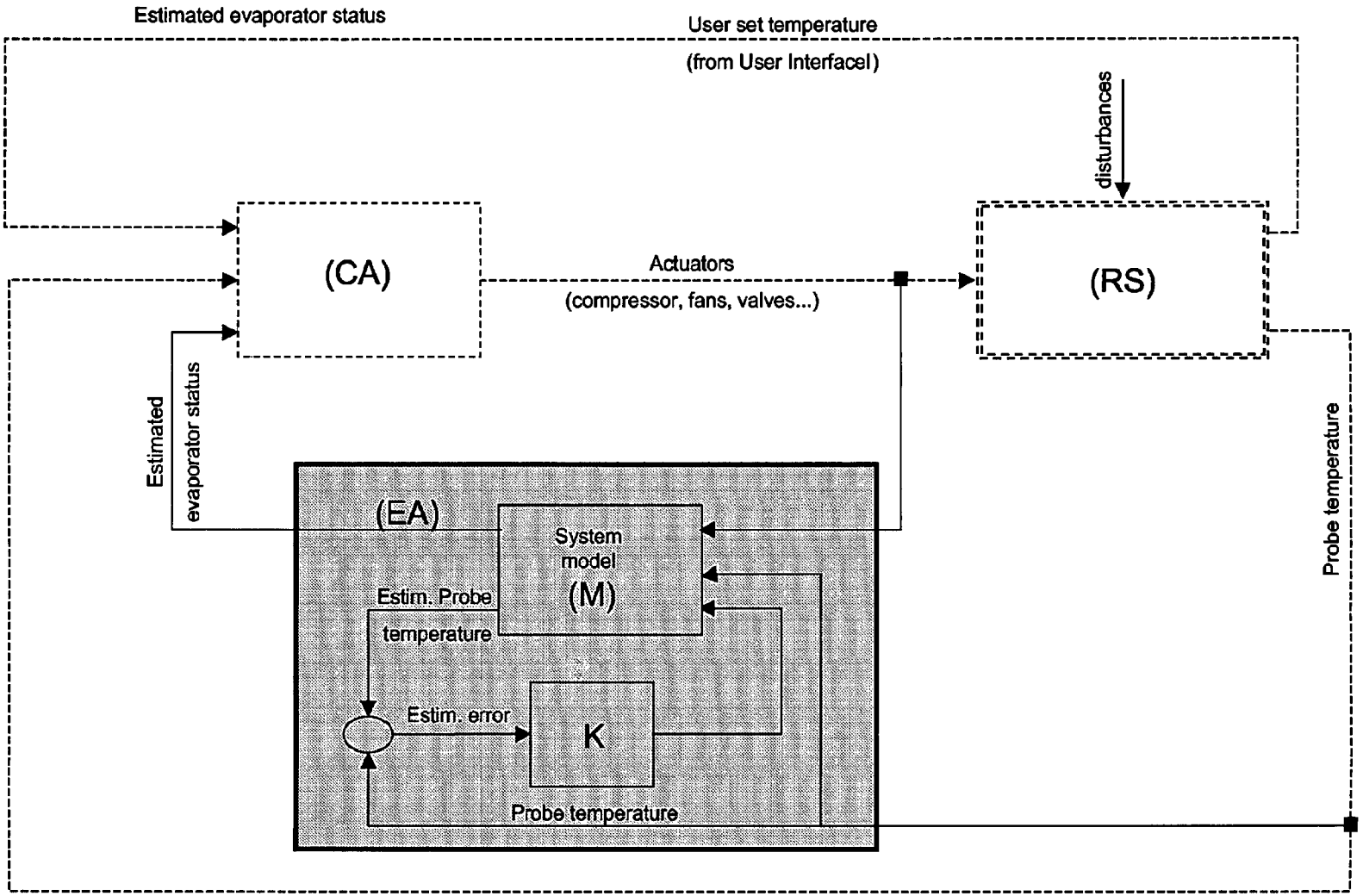
FIG. 3 is a block diagram showing the details of the estimation algorithm of FIG. 2.

FIG. 3 shows the block scheme of the estimation algorithm EA in a more detailed way. The estimation algorithm EA is composed of two main blocks M and K. The "model" block M consists of a mathematical model of the appliance. It can be obtained from the application of the thermodynamic and physical principles describing heat exchange between the probe area and the evaporator area. Alternatively or in addition to such kind of solution, computational intelligence techniques (such as neural network) can be used to implement the model block M.

The "error" block K weights the error between the measured probe temperature and the estimated one and it sends this data as a feedback to the model block M. This feedback is used by the model M block to adjust the estimations.

The presence of the error block K is justified by the presence of a certain degree of uncertainty that affects the system. Such uncertainty is related to the presence of disturbances (FIG. 2) and to the inevitable approximation of the model block M in describing the real system. The higher is the uncertainty, the higher the importance of the error block K will be. If the effects of the uncertainty are considered negligible, the error block K can be omitted.

Example of disturbances are the opening of the door, the presence of warm food (especially if adjacent to the temperature probe TP), the external temperature variations, the humidity conditions (inside and outside the cavity). The disturbances, by definition, can't be directly measured but the estimation algorithm EA can detect and estimate them to adjust the estimation by consequence. For example, by analyzing the probe temperature dynamics the estimation algorithm EA can recognize the presence of food inside the cavity and modify the parameters of the internal model block M by consequence.

The error block K can be used also for self-tuning the mathematical model M, so that the estimation algorithm can be adapted automatically to the specific refrigerator model. In this way a single software can be used for a wide range of refrigerator models.

A well-known technique to design blocks M and K consists on the application of the Kalman filtering technique.

According to the present invention, the control algorithm will use the estimated evaporator status to manage the evaporator defrost. This can be done for example by enabling the compressor startup, after each cooling cycle, just when the estimated evaporator temperature is greater than a fixed threshold. In this case the defrost should be done at each compressor cycling. Alternatively, the defrost could be done just when the estimated frost status (provided by the estimation algorithm EA) is greater than a pre-determined value.

Figure 4:
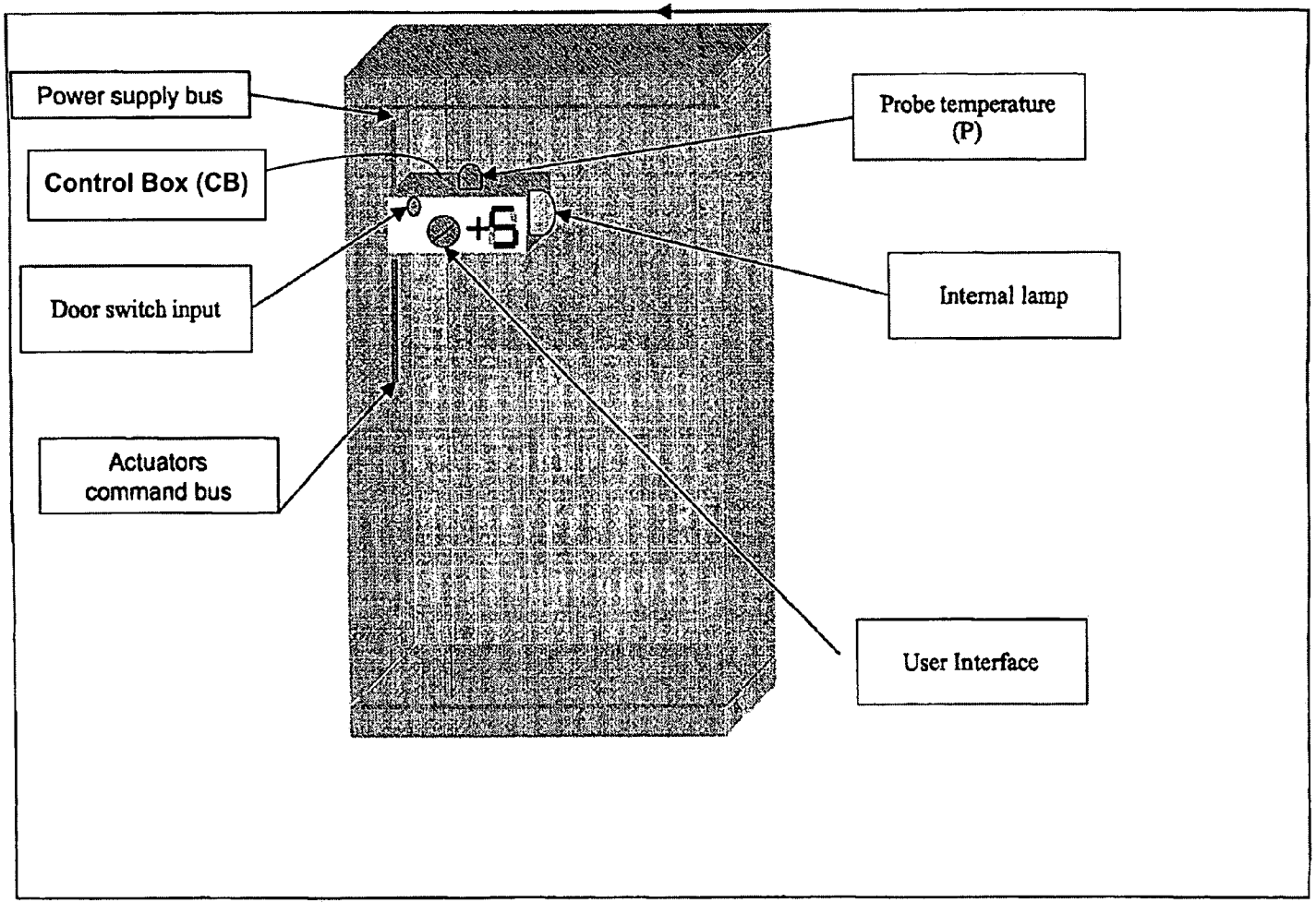
FIG. 4 is a schematic view of a refrigerator according to the invention in which the temperature sensor and the control hardware is located in a single control box inside the cavity.

As said before one of the main advantages of the present invention is the reduction of the wiring and assembly costs thanks to the elimination of the traditional evaporator temperature sensor. This advantage can be further increased if most of all the electrical/electronics devices are concentrated on a unique control box CB inside the cavity (as shown in FIG. 4). Such control box CB can include for example the temperature probe P, the user interface (UI), the micro-controller implementing the estimation algorithm EA and the control algorithm CA, electronic and electrical drivers for the actuators (relays, triacs) and input sensors (door switch, temperature probe etc.).

Even if the present invention is mainly applied to a static evaporator of a refrigerator cavity, it can be applied to no-frost evaporators (for refrigerators and freezer) as well. Traditionally, in these latter cases the evaporator is provided with a "bimetal" switch that acts as a temperature sensor. The status of the bimetal switch (open/closed) depends on the evaporator temperature and it is used by the control algorithm CA to detect the end of the defrost phase. The application of the technical solution according to the present invention would eliminate the bimetal switch.

Figure 5:
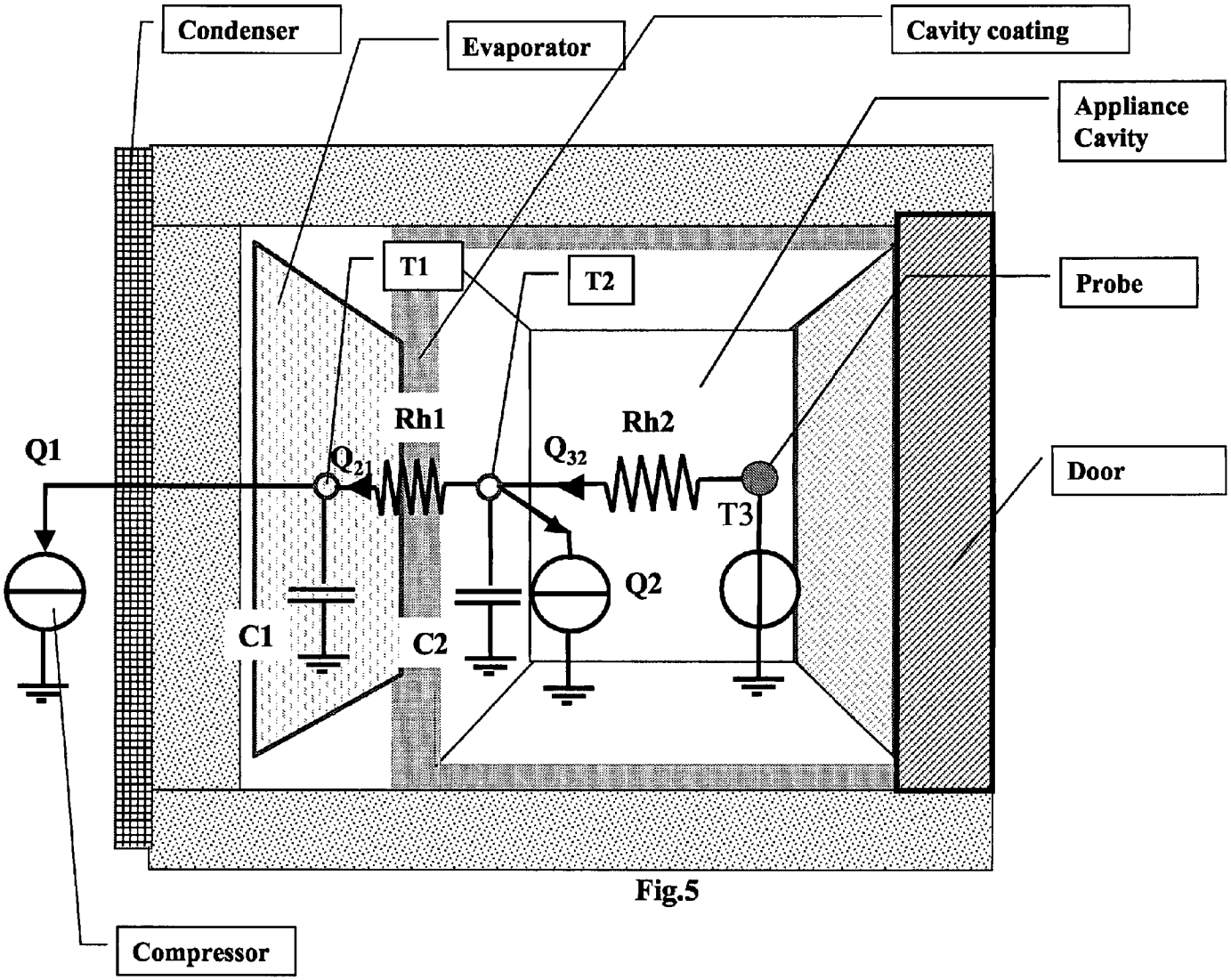
FIG. 5 is a schematic top view of a refrigerator cavity according to the invention, in which an equivalent electric circuit of the related thermodynamic model is shown.

A practical implementation of the present invention will be now described in the following example, in which a Whirlpool refrigerator cabinet code 850169816000 was modified according to the invention. FIG. 5 shows a schematic representation of this cabinet. The refrigerator cabinet of the example has an evaporator on the outside surface of the wall of the plastic liner. This is a very well known technique that has replaced the use of evaporators in the cell.

The example is based on the "reference model" technique. This means that the estimation of the evaporator temperature is performed on the basis of a simplified mathematical model describing the ice formation and heat exchange effects between the evaporator and the cabinet. An equivalent electric scheme of this model is shown in the above-mentioned FIG. 5.

According to this equivalence (electric-thermal), the resistance represents the inverse of a heat exchange coefficient (° C./W), and each capacitor represent a thermal capacity (J/° C.). The current on the generic branch represents a thermal flux (W) along that branch and, finally, the voltage on the generic node represents the temperature on that node (° C.).

The boundary condition of the model consists of two generators ($Q_1$ and $T_3$). The first one $Q_1$ describes the thermal flow rate carried away by the compressor. The second generator describes the temperature of the refrigerator cavity, and in this particular application it coincides with the probe temperature $T_p$.

The two main state variables of the models are the two temperatures $T_1$ and $T_2$. The first one describes the temperature of inner evaporator block. The second one describes the temperature of the plastic wall (liner) that covers the evaporator. This is the most important temperature because it corresponds to the area affected by the ice formation. In addition, a third state variable state ($x_{ice}$) is present to describe the energy absorbed or released by the $T_2$ node for the effect of the ice formation or melting.

The equations of the model are as follows:

$$\begin{cases} \frac{dT_1}{dt} = \frac{1}{C_1}\cdot(-Q_1 + Q_{21}) \\ \frac{dT_2}{dt} = \frac{1}{C_2}\cdot(-Q_{21} - Q_2 + Q_{32}) \\ \frac{dx_{ice}}{dt} = Q_2 \\ Q_1 = f_1(Rpm, T_2) \\ Q_{21} = \frac{1}{R_{h1}}\cdot(T_2 - T_1) \\ Q_{32} = \frac{1}{R_{h2}}\cdot Fan\cdot((T3 - T2) + K\cdot(T3 - T2)^3) \\ Q_2 = \begin{cases} 0 & (T2 \le 0;\ x_{ice} \le 0) \\ Qsc1 > 0 & (T2 > 0) \\ Qsc2 < 0 & (T2 \le 0;\ x_{ice} > 0) \end{cases} \end{cases} \quad (1)$$

The function $f_1$ describes the cooling capacity of the compressor in function of the speed (if a variable speed compressor is used) and the estimated temperature $T_2$.

The Fan factor is used to describe the possible presence of a fan inside the cavity.

The K coefficient takes in account the effect of the convective heat exchange between the cavity and the evaporator wall.

Figure 6:
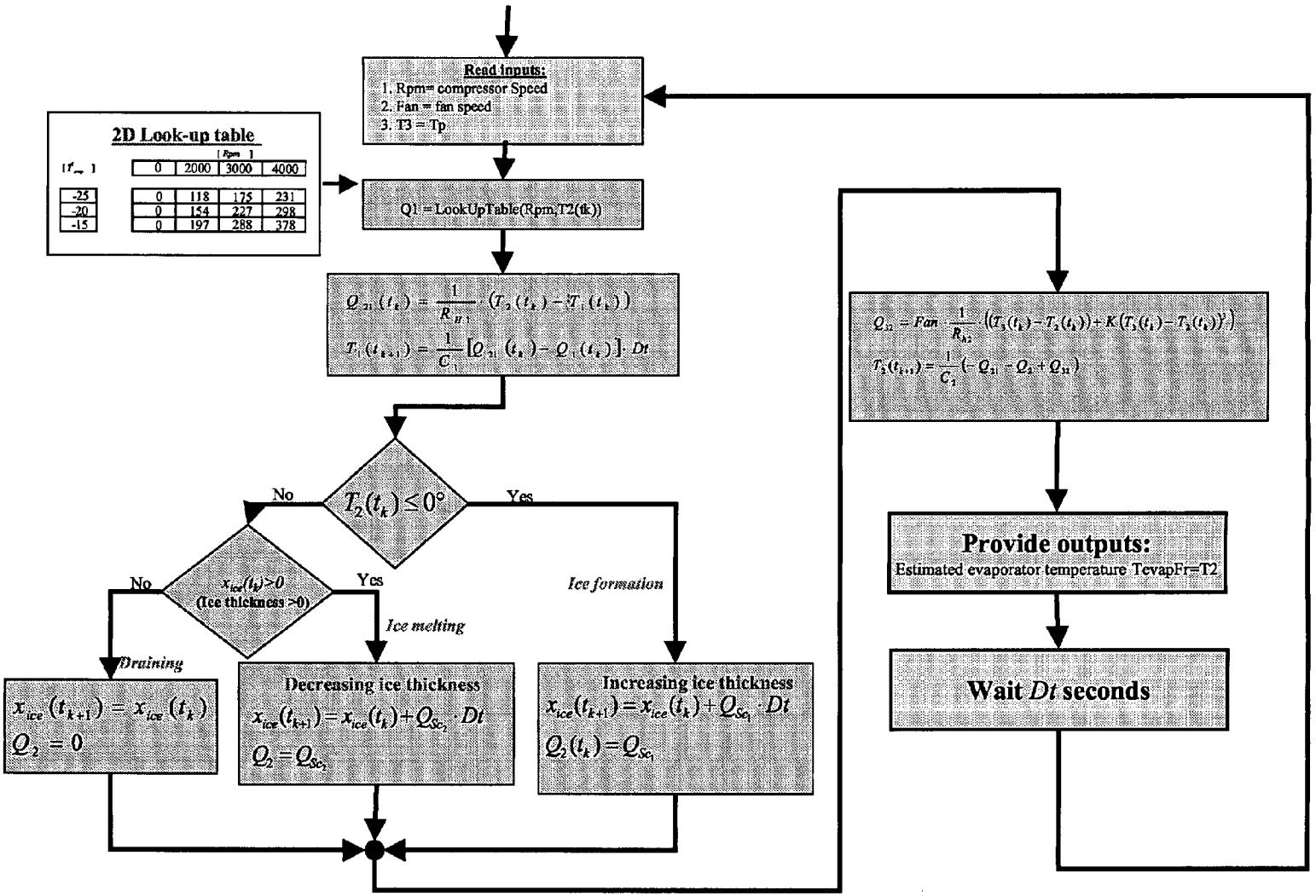
FIG. 6 is a flow chart showing the estimation algorithm according to the invention.

The flow chart in FIG. 6 shows the estimation algorithm based on the described model. It consists on a numerical integration of the equation system (1).

For the considered application, an integration time step Dt of 1 sec. was chosen.

The algorithm is composed on the following main steps:

1. Input reading. Compressor speed (if variable speed compressor is used) or compressor status (if On/Off compressor is used), fan state or fan speed, probe temperature value (temperature $T_3$).
2. Cooling capacity $Q_1$ computation. This is done through the 2d look-up table annexed to the flow chart. This look-up table was obtained from the compressor characteristics provided by the supplier (equation 4 of system (1)).
3. Integration of the equation of the node $T_1$ (equation no. 1 and 5 of system (1)).
4. Integration of the equation of the ice formation. (equation 3 and 7 of system (1)).
5. Integration of the equation of the node $T_2$ (equation 2, 5 and 6 of system (1)).

The temperature T2 is the estimation of the evaporator temperature that is passed to the control algorithm to manage the defrost function.

Figure 7:
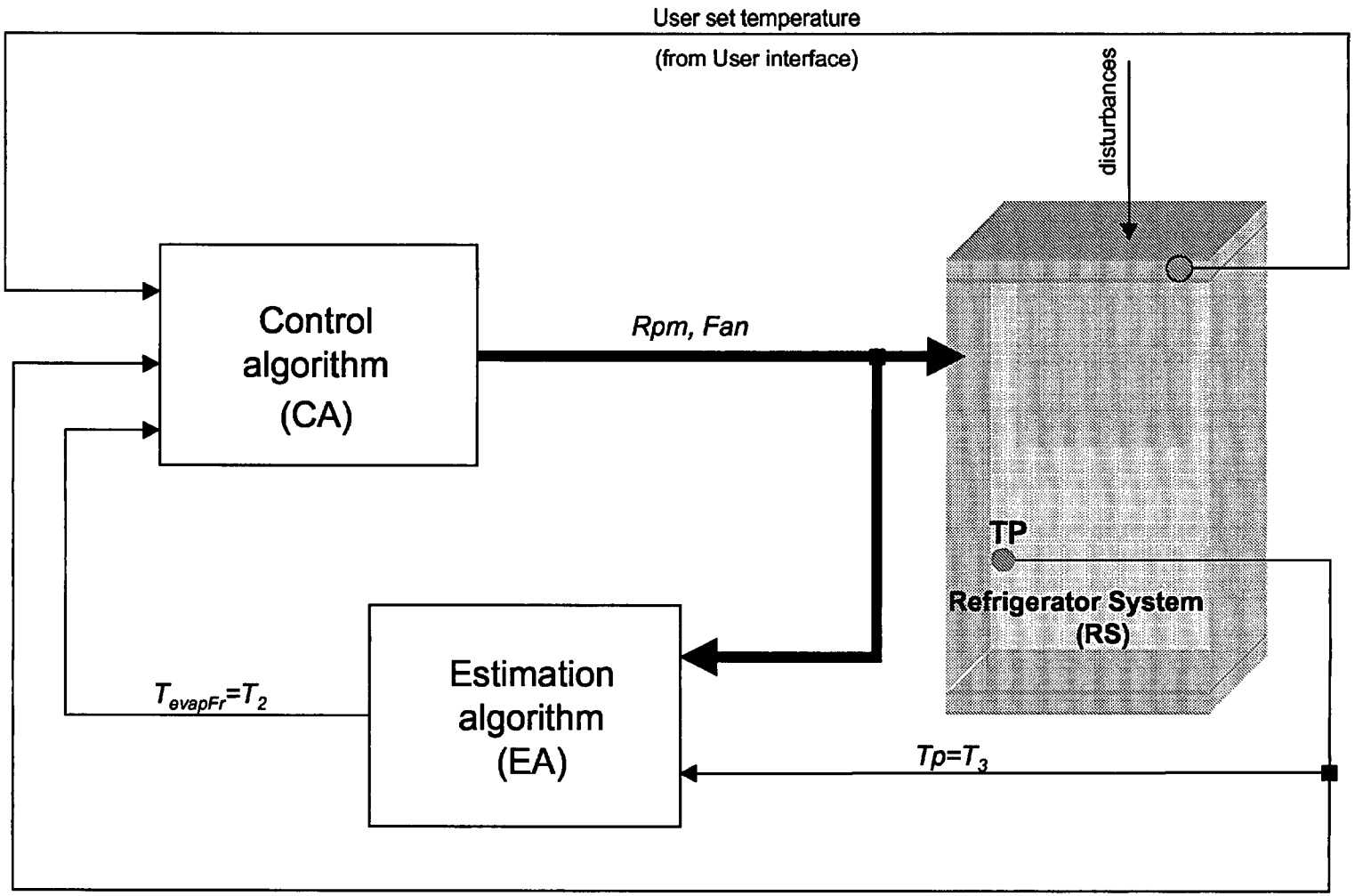
FIG. 7 shows a block diagram of the estimation algorithm according to the invention.

FIG. 7 shows a block diagram description of the presented implementation.

FIG. 9 summarizes the main parameters used in the algorithm of the example, and their numerical values. Such values were experimentally identified during the design phase.

Figure 8:
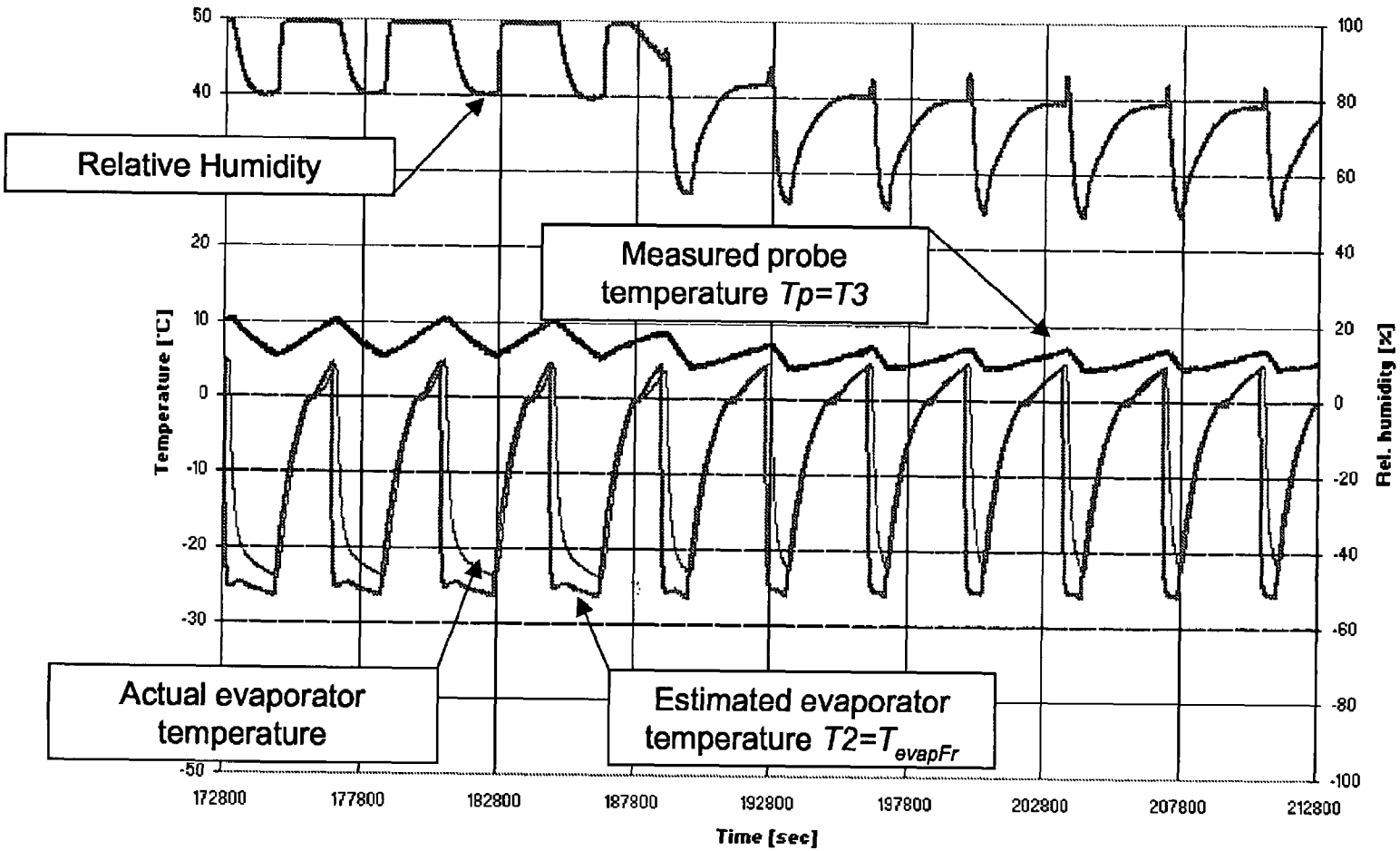
FIG. 8 is a diagram showing examples of actual performances of the algorithm according to the invention applied to a refrigeration appliance with and without humid load inside the cavity.

FIG. 8 shows an example of performances of the described algorithm applied to the above-mentioned appliance with and without humid load inside the cavity. The control algorithm enables the compressor start-up at each cycle, when the estimated evaporator temperature is higher than 4.5° C. It can be appreciated that the difference between the actual evaporator temperature and the estimated temperature at the compressor start-up is lower than 1° C. This is an evidence of an acceptable precision of the estimation algorithm in recognizing the end of defrost phase.

Of course the above mentioned algorithm must be considered only as an example of a possible implementation of the present invention. As described above, different solutions based on alternative techniques, referable to the generic block scheme of FIG. 3, can be used for the estimation (Kalman filters, neural fuzzy etc.).

The invention claimed is:

1. A method for controlling the defrost of an evaporator in a refrigeration appliance provided with a compressor, in which a temperature sensor (TP) is used for detecting the temperature inside a cell of the appliance, comprising the steps of estimating the temperature of the evaporator on the basis of the cell temperature and of a mathematical model (M) of the refrigeration appliance, and enabling the compressor startup when the estimated evaporator temperature is greater than a fixed threshold indicative of the evaporator being defrosted.

2. The method according to claim 1, wherein the mathematical model (M) of the appliance is obtained from the application of thermodynamic and/or physical data describing the heat exchange between the cell area where the temperature sensor (TP) is placed and the evaporator area.

3. The method according to claim 1, wherein the mathematical model of the appliance is obtained from the application of computational intelligence techniques.

4. The method according to claim 1, wherein the temperature of the cell is also estimated and it is compared with the sensed temperature of the cell, the error value between the estimated and the measured value (Eerr) being used to adjust the estimation of the evaporator temperature.

5. The method according to claim 4, wherein the error value Eerr is used for modifying the mathematical model (M) in order to cope with external disturbances.

6. The method according to claim 4, wherein the error value Eerr is used for self tuning the mathematical model (M) in order to adapt the estimation of the evaporator temperature to different models of refrigeration appliances.

7. A refrigeration appliance comprising:

a refrigeration circuit including an evaporator and a compressor, a control circuit for controlling the operation of the refrigeration appliance including the evaporator defrost, and a temperature sensor (TP) placed in a cell of the appliance, wherein the control circuit is adapted to carry out an estimation algorithm (EA) which provided an estimated value of the evaporator temperature, such estimation algorithm (EA) being based on the measured temperature of the cell and on a mathematical model (M) of the appliance, so that the control circuit can enable the compressor startup when the estimated evaporator temperature is greater than a fixed threshold indicative of the evaporator being defrosted.

8. The refrigeration appliance according to claim 7, wherein the control circuit is adapted to carry out a comparison between the measured temperature of the cell and the estimated value thereof provided by the estimation algorithm (EA).

9. The refrigeration appliance according to claim 8, wherein the error value (Eerr) deriving from the comparison between the measured temperature of the cell and the estimated value thereof is adapted to be used for adjusting the estimation of the evaporator temperature and/or for modifying the mathematical model (M).

10. The refrigeration appliance according to claim 8, wherein the error value (Eerr) deriving from the comparison between the measured temperature of the cell and the estimated value thereof is adapted to be used for self tuning the mathematical model (M) in order to adapt the estimation algorithm (EA) to different models of refrigeration appliances.

11. The refrigeration appliance according to claim 10, wherein the estimation algorithm (EA) is based on Kalman filter.

12. The refrigeration appliance according to claim 10, wherein the estimation algorithm (EA) is based on computational intelligence techniques.

13. The refrigeration appliance according to claim 12, wherein the control circuit, the temperature sensor (TP) and a microprocessor implementing the estimation algorithm (EA) are placed in a single control box (CB) in the cell.

14. The refrigeration appliance according to claim 13, wherein the control box (CB) comprises a user interface, electronic and/or electrical drivers for actuators and input sensors.

15. The refrigeration appliance according to claim 7, wherein the estimation algorithm (EA) is based on Kalman filter.

16. The refrigeration appliance according to claim 7, wherein the estimation algorithm (EA) is based on computational intelligence techniques.

17. The refrigeration appliance according to claim 7, wherein the control circuit, the temperature sensor (TP) and a microprocessor implementing the estimation algorithm (EA) are placed in a single control box (CB) in the cell.

* * * * *

UNITED STATES PATENT AND TRADEMARK OFFICE

CERTIFICATE OF CORRECTION

PATENT NO. : 7,665,317 B2
APPLICATION NO. : 11/572446
DATED : February 23, 2010
INVENTOR(S) : Boer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 407 days.

Signed and Sealed this

Seventh Day of December, 2010

David J. Kappos

David J. Kappos
*Director of the United States Patent and Trademark Office*